US011719087B2

(12) United States Patent
Annaiyappa

(10) Patent No.: US 11,719,087 B2
(45) Date of Patent: Aug. 8, 2023

(54) MODELING FRICTION ALONG A WELLBORE

(71) Applicant: Nabors Drilling Technologies USA, Inc., Houston, TX (US)

(72) Inventor: Pradeep Annaiyappa, Houston, TX (US)

(73) Assignee: Nabors Drilling Technologies USA, Ino., Houston, TX (US)

( * ) Notice: Subject to any disclaimer, the term of this patent is extended or adjusted under 35 U.S.C. 154(b) by 675 days.

(21) Appl. No.: 16/549,849

(22) Filed: Aug. 23, 2019

(65) Prior Publication Data

US 2020/0063533 A1 Feb. 27, 2020

Related U.S. Application Data

(60) Provisional application No. 62/722,541, filed on Aug. 24, 2018.

(51) Int. Cl.
*E21B 44/04* (2006.01)

(52) U.S. Cl.
CPC ..... *E21B 44/04* (2013.01)

(58) Field of Classification Search
CPC ..... E21B 41/0092; E21B 21/08; E21B 44/02; E21B 49/003; E21B 44/04; E21B 44/06; E21B 44/00; E21B 41/00; E21B 43/00; E21B 43/16
See application file for complete search history.

(56) References Cited

U.S. PATENT DOCUMENTS

| | | | | |
|---|---|---|---|---|
| 6,206,108 | B1 | 3/2001 | Macdonald et al. | |
| 8,528,663 | B2 | 9/2013 | Boone | |
| 8,939,233 | B2 | 1/2015 | Edbury et al. | |
| 10,400,570 | B2 * | 9/2019 | Erge | E21B 44/00 |
| 10,662,751 | B2 * | 5/2020 | Payette | E21B 44/04 |
| 10,851,640 | B2 * | 12/2020 | Gillan | E21B 44/04 |
| 11,215,045 | B2 * | 1/2022 | Harmer | E21B 44/04 |
| 2013/0032407 | A1 * | 2/2013 | Edbury | E21B 49/005 175/61 |
| 2013/0146358 | A1 | 6/2013 | Disantis | |
| 2014/0291023 | A1 * | 10/2014 | Edbury | E21B 21/08 175/24 |
| 2015/0226049 | A1 * | 8/2015 | Frangos | E21B 49/00 702/6 |
| 2016/0108725 | A1 * | 4/2016 | Benson | E21B 7/24 367/82 |
| 2016/0145993 | A1 | 5/2016 | Gillan et al. | |
| 2016/0237802 | A1 | 8/2016 | Boone et al. | |

(Continued)

OTHER PUBLICATIONS

Wang et al., "Modeling Friction Performance of Drill String Torsional Oscillation Using Dynamic Friction Model" (Year: 2017).*

(Continued)

*Primary Examiner* — Jay Hann
(74) *Attorney, Agent, or Firm* — Abel Schillinger, LLP

(57) ABSTRACT

Systems and methods for subterranean drilling operations comprising: adjusting a wellbore parameter; measuring a time interval between adjustment of the wellbore parameter and a resulting change at a bottom hole assembly of a drill string; using the measured time interval and determining resistance in the wellbore; and modeling the resistance to form a friction model of the wellbore.

19 Claims, 2 Drawing Sheets

(56) References Cited

U.S. PATENT DOCUMENTS

2016/0369619 A1* 12/2016 Parmeshwar ..... E21B 47/00
2018/0320501 A1* 11/2018 Jeffryes ..... E21B 44/04

OTHER PUBLICATIONS

Lei, Lingyun. "Downhole Weight on Bit Prediction with Analytical Model and Finite Element Method". A Thesis Submitted to the Faculty of Graduate Studies in Partial Fulfilment of the Requirements for the Degree of Master of Science, University of Calgary, Alberta, Aug. 2014, 102 pages.

Hareland, Geir et al., "Finite Element Analysis of Drillstring and Its Application on Torque and Drag Calculation", The International Journal of Engineering and Science (IJES), vol. 2, Issue 2, pp. 9-16, 2013.

Duplantis, Steven. "Slide Drilling—Farther and Faster". Oilfield Review 28, No. 2, May 2016. pp. 50-56.

* cited by examiner

MODELING FRICTION ALONG A WELLBORE

CROSS-REFERENCE TO RELATED APPLICATION

This application claims priority under 35 U.S.C. § 119(e) to U.S. Provisional Patent Application No. 62/722,541 entitled "Systems and Methods of Subterranean Drilling Operations," by Pradeep ANNAIYAPPA, filed Aug. 24, 2018, which is assigned to the current assignee hereof and incorporated herein by reference in its entirety.

FIELD OF THE DISCLOSURE

The present disclosure relates to subterranean drilling operations, and more particularly to systems and methods associated with modeling friction along a wellbore during subterranean drilling.

RELATED ART

Subterranean drilling operations typically utilize a drill string coupled with a surface drive unit to bore a drill bit into a subterranean formation. As the drill string advances into the subterranean formation the distance between the drive unit and the drill bit increases, thereby lengthening the wellbore.

To maintain active coupling between the drill bit and the drive unit, pipe segments or pipe stands are routinely added to the drill string at the surface of the wellbore. Addition of pipe segments or pipe stands can occur at routine, or generally routine, intervals often prescribed by the length of pipe segment and the particular tool makeup of the drill site.

Particularly during start up of drilling operations after adding a new pipe segment or pipe stand, the drill string can become trapped or stuck in the wellbore as a result of static friction, often referred to as stiction, of the drill string along the wellbore wall. As such, the drive unit typically over-torques the drill string to commence rotational or longitudinal movement thereof. Such over-torqueing can be damaging to the drill string, drill bit, equipment on the surface, or other components of the drilling operation. For example, mud pumps and top drives can experience rapid wellbore changes which stress the equipment. The drill string can suffer bends, breaks, or weaken as a result of internal forces. Similarly, the drill bit can hit off bottom of the wellbore or become damaged during rapid torqueing actions.

The drilling industry continues to demand improvements in subterranean drilling operations to reduce over-torqueing and associated frictional drag on the drill string. More particularly, the industry continues to demand improved systems for accurately determining or correcting wellbore operations such as stiction or even kinetic friction.

BRIEF DESCRIPTION OF THE DRAWINGS

Embodiments are illustrated by way of example and are not limited in the accompanying figures.

DETAILED DESCRIPTION

Figure 1:
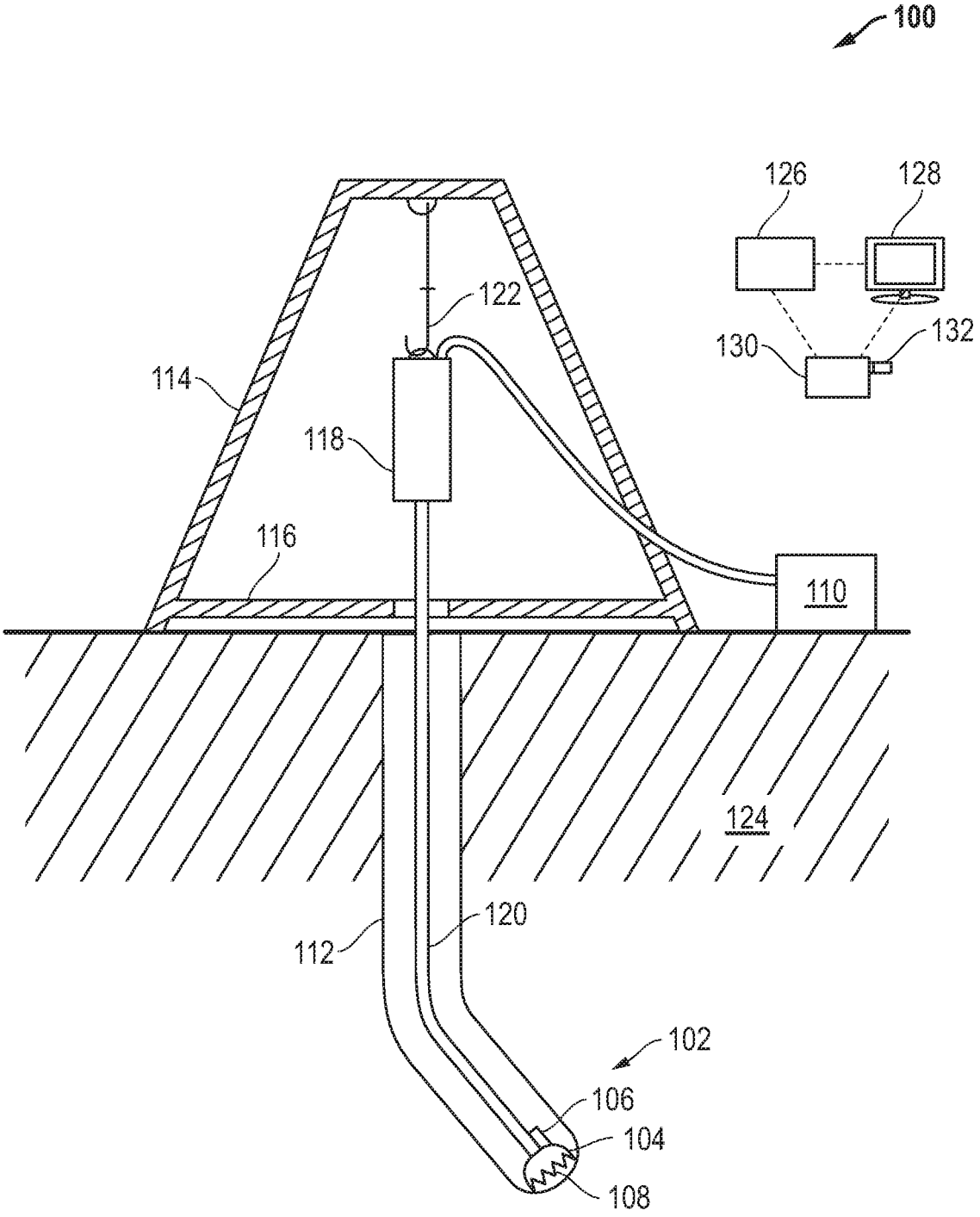
FIG. 1 includes a schematic view of a system for subterranean drilling operations in accordance with an embodiment.

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other embodiments can be used based on the teachings as disclosed in this application.

The terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one, at least one, or the singular as also including the plural, or vice versa, unless it is clear that it is meant otherwise. For example, when a single item is described herein, more than one item may be used in place of a single item. Similarly, where more than one item is described herein, a single item may be substituted for that more than one item.

As used herein, "generally equal," "generally same," and the like refer to deviations of no greater than 10%, or no greater than 8%, or no greater than 6%, or no greater than 4%, or no greater than 2% of a chosen value. For more than two values, the deviation can be measured with respect to a central value. For example, "generally equal" refer to two or more conditions that are no greater than 10% different in value. Demonstratively, angles offset from one another by 98% are generally perpendicular.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in textbooks and other sources within the drilling arts.

A method for subterranean drilling operations in accordance with an embodiment can include adjusting a wellbore parameter, measuring a time interval between adjustment of the wellbore parameter and a resulting change at a bottom hole assembly of a drill string, using the measured time interval and determining resistance in the wellbore, and modeling the resistance to form a friction model of the wellbore.

In an embodiment, adjusting the wellbore parameter can occur at a location at or adjacent to the surface of the wellbore. For example, adjusting the wellbore parameter can include adjusting a valve on a mud pump, altering a torque or speed of the drill string at a top drive or drive unit, adjusting or tracking rotational orientation of a portion of the face of a drill bit or other portion of the bottom hole assembly, adjusting movement of the drill string in a longitudinal direction, or any combination thereof.

The time interval T between adjustment of the wellbore parameter and a resulting change at a bottom hole assembly can be measured by one or more processors or logic devices associated with the system. In an embodiment, the time interval T can be used to calculate friction values for the wellbore. In a particular embodiment, the friction values can be calculated at a plurality of approximately equally spaced locations in the wellbore or at a plurality of approximately equally spaced apart time periods during drilling operations. In a particular instance the plurality of approximately equally spaced locations or times can generally correspond to times when pipes or pipe stands are added to the drill string.

A wellbore friction model can be created based on the friction values calculated along the wellbore. The friction values calculated at each location of the wellbore can include all friction acting on the drill string when the drill bit (or BHA) is at that location in the wellbore. Therefore, the amount of friction calculated at the previous location should be removed from the friction values at the current location to determine the incremental change in the friction profile that has occurred when the drill string was extended into the wellbore the distance from the last location to the current location. As the drill string is further extended into the wellbore, this process can be repeated to develop an incremental friction profile of the wellbore that can be used to develop a friction model of the wellbore.

In an embodiment, a system for conducting subterranean operations can generally include a wellbore friction modeling system including a logic device and a controller. The logic device can be adapted to calculate a time interval between adjustment of a wellbore parameter at the surface and occurrence of the wellbore parameter at a bottom hole assembly. The controller can be configured to receive a command signal from the logic device with instructions to change a control parameter in response to the time interval. In an embodiment, the logic device can map a wellbore friction model using the calculated time interval.

In an embodiment, a method for subterranean drilling operations can include transmitting a control signal from a surface of a subterranean formation to a bottom hole assembly of a drill string in a wellbore, adjusting a wellbore parameter at the surface, such that the adjusted wellbore parameter causes a resulting change of the wellbore parameter at the bottom hole assembly, measuring a time interval T(1) between when the control signal is transmitted at the surface and when the wellbore parameter is adjusted at the surface, measuring a time interval T(2) between when the control signal is received at the bottom hole assembly and when the resulting change is detected at the bottom hole assembly, and determining resistance in the wellbore based on differences between the T(1) and T(2) time intervals.

In an embodiment, a system for conducting subterranean operations can include a wellbore friction modeling system that can include a logic device adapted to initiate transmission of a control signal from a surface of a subterranean formation to a bottom hole assembly, initiate an adjustment of a wellbore parameter at the surface with a resulting change of the wellbore parameter at the bottom hole assembly in response to the adjustment, calculate a time interval T(1) between when the control signal is transmitted at the surface and when the wellbore parameter is adjusted at the surface, and calculate a time interval T(2) between when the control signal is received at the bottom hole assembly and when the resulting change is detected at the bottom hole assembly. The system can further include a controller configured to receive instructions from the logic device to calculate a resistance in the wellbore in response to a time interval T that is based on a difference between the time intervals T(1) and T(2).

Referring to FIG. 1, a system 100 in accordance with an embodiment herein can generally include a drilling apparatus 102 having a drill bit 104 with a steerable motor 106 having a tool face 108 and a rotary drive adapted to steer the bit 104 during drilling operations.

The drill bit 104 can be disposed within, or part of, a bottom hole assembly (BHA). In an embodiment, the steerable motor 106 can be adapted to be controlled by a user, such as a driller. In another embodiment, the steerable motor 106 can be adapted to be controlled by one or more logic elements, such as one or more microprocessors, adapted to steer the bit 104 during drilling operations. In a particular instance, systems 100 for directional drilling applications can include the steerable motor 106 or other device adapted to reorient the tool face 108 to maintain the drilling operation within the wellbore plan.

In an embodiment, the drilling apparatus 102 can further include a mud pump system 110 which can include one or more pumps coupled to an annulus of a wellbore 112 being drilled. In an embodiment, the mud pump system 110 can circulate drilling fluid, such as drilling mud, through the wellbore 112. The mud pump system 110 can include one or more pumps which can be used to raise a pressure in the wellbore 112, lower the pressure in the wellbore 112, adjust fluid flow, stop fluid flow, start fluid flow, or combinations thereof. In an embodiment, the mud pump system 110 can further include an agitating device such as a mud-gas-separator or shaker, seals, chokes, valves, manifolds, fluid lines, mud pits, an MPD control device, or any combination thereof.

In a certain embodiment, the drilling apparatus 102 can include a mast 114 and a rig floor 116. The mast 114 can be disposed over the wellbore 112 such that a drive unit 118, (e.g. a top drive) can rotatably control a drill string 120 coupled with the bit 104. In an embodiment, a hook 122 can be suspended from the mast 114 to support the drive unit 116, drill string, or a combination thereof. In a particular instance, the hook 122 can be lowered from the mast 114, lowering the drive unit 118 and drill string 120 into the wellbore 112. For example, the hook 122 can be coupled with a drawworks (not illustrated). As the drill string 120 descends into the wellbore, the bit 104 can remove portions of the subterranean formation 124 below the wellbore 112, allowing the hook 122 to lower the drill string 120 deeper into the wellbore 112.

Drilling can be paused for a duration of time to add a new pipe segment or pipe stand to the drill string 120. Addition of new pipe segments or pipe stands can permit further advancement of the bit 104 into the wellbore 112.

In certain instances, a plurality of pipe segments used by the drilling apparatus 102 can have approximately the same length when compared to one another. For example, at least two pipe segments can have approximately the same length when compared to one another. In a more particular embodiment, at least three pipe segments can have approximately the same length when compared to one another. Thus, adding new pipe segments to the drill string 120 can occur at substantially uniform intervals of wellbore depth advancement. In an embodiment, at least three pipe segments having approximately the same length can be added to the drill string 120 successively. Thus, the formation of a pipe joint between adjacent pipe segments can occur at approximately equally spaced apart wellbore depths. In other instances, a plurality of pipe stands including a plurality of discrete pipe segments, such as at least two or at least three pipe segments coupled together (i.e. pipe stands), can be used by the drilling apparatus 102. In a particular embodiment, at least three of the plurality of pipe stands can have approximately the same length when compared to one another. Thus, adding new pipe stands to the drill string 120 can occur at substantially uniform intervals of wellbore depth advancement.

In an embodiment, the mud pump system 110 can be coupled with the wellbore 112 through the drive unit 118. The mud pump system 110 can circulate mud from a mud pit, through the drive unit 118 and drill string 120 to the bit 104. The mud can return to the surface with cuttings, gas, vapors, and other drilled components where it can be agitated or cleaned of cuttings, gases, and vapors. The mud can then return to the mud pit and be recirculated through the wellbore 112.

In an embodiment, the system 100 can further include a receiving apparatus 126 adapted to receive electronic data. In a particular embodiment, the receiving apparatus 126 can be adapted to receive electronic data on a recurring basis. The electronic data can correspond with a travel time associated with one or more adjustable parameters of the wellbore drilling operation. For example, the electronic data can include mud travel time data, actual rotation travel time data, theoretical rotation travel time data, actual tool face data, or any combination thereof. Actual mud travel time data can refer to a duration of time between adjustment of a condition of mud used in the system 100, as performed at or near the surface, and when the resulting condition is detectable at the bit 104. By way of example, the adjusted condition of the mud can include an adjusted pressure of mud in the wellbore 112 caused by increasing the pressure of one or more pumps of the mud pump system 110. Actual rotation travel time data can refer to a duration of time between adjustment of a condition of rotation of the drill string 120, as performed at or near the surface, and when the resulting condition is detectable at the bit 104. Theoretical rotation travel time data can refer to a theoretical duration of time between adjustment of a condition of rotation of the drill string 120, as theoretically performed at or near the surface, and when the resulting condition is theoretically detectable at the bit 104. Actual tool face orientation data can refer to the theoretical angular orientation of the tool face as compared to the actual angular orientation of the tool face.

In another embodiment, the electronic data can include time intervals T(1) and T(2), which are time intervals between when the one or more adjustable parameters of the wellbore drilling operation are adjusted at or near the surface and when a resulting change in the parameter is detected downhole (e.g. at the drill bit 104, or at the BHA, or both). For example, one or more adjustable parameters can include axial movement (i.e. inward or outward relative to the wellbore) of the drill string, rotational movement of the drill string, rotational speed of the drill string, or any combination thereof. Due to possible inaccuracies between timers at various locations (e.g. at the surface, at the drill bit 104, at the BHA, at an intermediate location in the wellbore, etc.), time stamps performed by various timers can introduce errors if the time stamp of one timer is not in sync with time stamps of other timers. Therefore, the travel times mentioned above can be determined by reading electronic data from the surface and BHA equipment (e.g. the drill bit 104), with the electronic data including time stamps for the data to allow data correlation when comparing electronic data from the surface equipment to electronic data from the BHA. However, as mentioned, these separate timers (e.g. one or more at the surface, and one or more at the BHA and/or bit 104) may not be in sync and therefore may introduce errors in correlation of the electronic data from various sources.

The mud travel time data, actual rotation travel time data, theoretical rotation travel time data, and other travel time data can be used to determine a resistance to movement of the drill string in the wellbore 112. For example, comparing the actual rotation travel time to the theoretical rotation travel time can be used to determine the resistance acting on the drill string 120 in the wellbore 112. The comparison can include comparing a difference in travel time between the actual rotation travel time and the theoretical rotation travel time. In general, increased resistance will increase the difference between the actual rotation travel time and the theoretical rotation travel time, where the theoretical rotation travel time can assume a resistance of zero "0."

Measuring the travel time for the actual rotation of the drill string 120 from at or near the surface to the drill bit 104 (which can be included in the BHA) can include receiving electronic data from sensors at or near the surface that detect when the drill string rotation at or near the surface begins (or when the drill string rotation speed changes). Sensors at the drill bit 104 (or at the BHA) can detect when the wellbore parameter changed at the surface (in this case drill string 120 rotation) results in a change of the wellbore parameter at the drill bit 104 or the BHA. Comparing the data from the surface sensors to the data from the BHA sensors can produce a time interval from when the wellbore parameter was changed at the surface to when the resulting condition (the wellbore parameter changes downhole) is detected at the BHA or drill bit 104. Comparing this actual travel time of the wellbore parameter change along the drill string 120 in the wellbore 112 can be compared to a theoretical travel time (resistance equal to zero "0") of the wellbore parameter change along the drill string 120 in the wellbore 112, the effects of resistance in the wellbore 112 on the drill string 120 can be calculated.

The travel time can be the time interval T between when the wellbore parameter is adjusted at the surface and when the wellbore parameter adjustment is seen at the BHA. The time interval T can be used to determine the wellbore resistance. If a control signal were used to initiate the time measurements, so that the wellbore parameter is adjusted at the surface when the control signal is received at the surface, and the time interval T can be measured from when the control signal is received at the surface and when the wellbore parameter adjustment is seen at the BHA, assuming the wellbore is adjusted at the surface when the control signal is received at the surface.

However, the time interval T can still be determined if the wellbore parameter is adjusted at the surface at a time after when the control signal is received at the surface. In this case, a time interval T(1) can be measured between when the control signal is received at the surface and when the wellbore parameter is adjusted at the surface. A time interval T(2) can be measured between when the control signal is received at the surface and when the wellbore parameter adjustment is seen at the BHA. The time interval T can be determined by subtracting time interval T(1) from time interval T(2), which removes the time delay between detecting the control signal at the surface and the beginning of adjusting the wellbore parameter at the surface.

If the timer at the surface and the timer at the BHA are in sync with each other, then the time interval T can be determined by comparing the time stamp from one timer at the surface when the wellbore parameter is adjusted to the time stamp from one timer at the BHA when the wellbore parameter is changed at the BHA as a result of the adjustment at the surface. However, in other embodiments, these timers may not be in sync with each other and thus may yield less accurate results if the time stamps being compared are not referenced to a same time. Due to the downhole conditions, timers at the BHA can tend to shift in time (i.e. a delay when compared to the surface timers) as well as drift (i.e. when a second in time measured by the BHA timers is not equal to a second in time measured by the surface timers). Inaccuracies in the time measurements between the surface timers and the BHA timers can introduce further inaccuracies in measuring the time interval T.

By measuring time interval T(1) with one timer at the surface and measuring time interval T(2) with another timer at the BHA, these measurements are not sensitive to inaccuracies between the two timers. This removes the inaccuracies caused by a shift between the BHA timers and the surface timers. The inaccuracies caused by the drift are seen to be negligible since the time span for time intervals T(1) and T(2) are usually on the order of 30 seconds, and the amount of drift in the timers can be assumed to be zero "0" since the errors are so small. However, if the time span were to be elongated to a span that the errors were significant, then time can be measured between two events that are spaced sufficiently apart in time, comparing the time measurements of the BHA timers and the surface timers and producing a calibration factor to adjust time measurements of the BHA timers.

In these embodiments, a control signal can be used to remove (or at least minimize) inaccuracies caused by out of sync timers. The control signal can be transmitted from the surface to the BHA, with the control signal being detected at the surface and at the BHA. It is preferred that this control signal can travel through the wellbore or subterranean formation at or near the speed of sound to ensure the control signal will arrive at the BHA before the adjusted wellbore parameter arrives at the BHA. The delay in transmitting the control signal (such as a pressure pulse, fluid flow adjustments, etc.) from the surface to the BHA can also be calculated since the characteristics of the fluid in the wellbore (e.g. drilling mud) is known and the travel speed of the control signal in the wellbore fluid can be calculated.

The time interval T can be calculated by measuring the time interval T(1) between the control signal detected at the surface and when the wellbore parameter is adjusted at the surface. This time interval T(1) can range from zero "0" to minutes or hours or longer. A time interval T(2) can be measured, where the time interval T(2) indicates the time between when the control signal is received by the BHA (or drill bit 104) and when a resulting wellbore parameter adjustment is seen at the BHA. The time interval T is then calculated by determining a difference between the time interval T(1) and the time interval T(2). The time interval T can still be equivalent to the time it takes for the wellbore parameter adjustment to travel from the surface to the BHA, but the time measurements are immune to the variations (i.e. inaccuracies) in time stamps between the surface and BHA timers. The time intervals T(1) and T(2) are measured by generally independent timers and the time read by one timer is relative to that timer and is not affected by the time read by the other timer. The beginning and end time for time interval T(1) can be measured by one timer with the beginning and end time for time interval T(2) being measured by another timer T(2). This allows any variations in time stamps (or time measurements) between independent timers to have no impact (or minimal impact) on the accuracy of the time interval T being determined from the time intervals T(1) and T(2).

In certain instances, the system 100 can include a display apparatus 128 adapted to display the electronic data, or a representation thereof, on a user-viewable display. In certain embodiments, the display apparatus 128 is coupled with a controller or hardware of the drilling apparatus 102. In an embodiment, the display apparatus 128 can be part of, or coupled with, an existing display apparatus of the drilling apparatus 102. In an embodiment, the display apparatus 128 can be in communication with the receiving apparatus 126.

Figure 2:
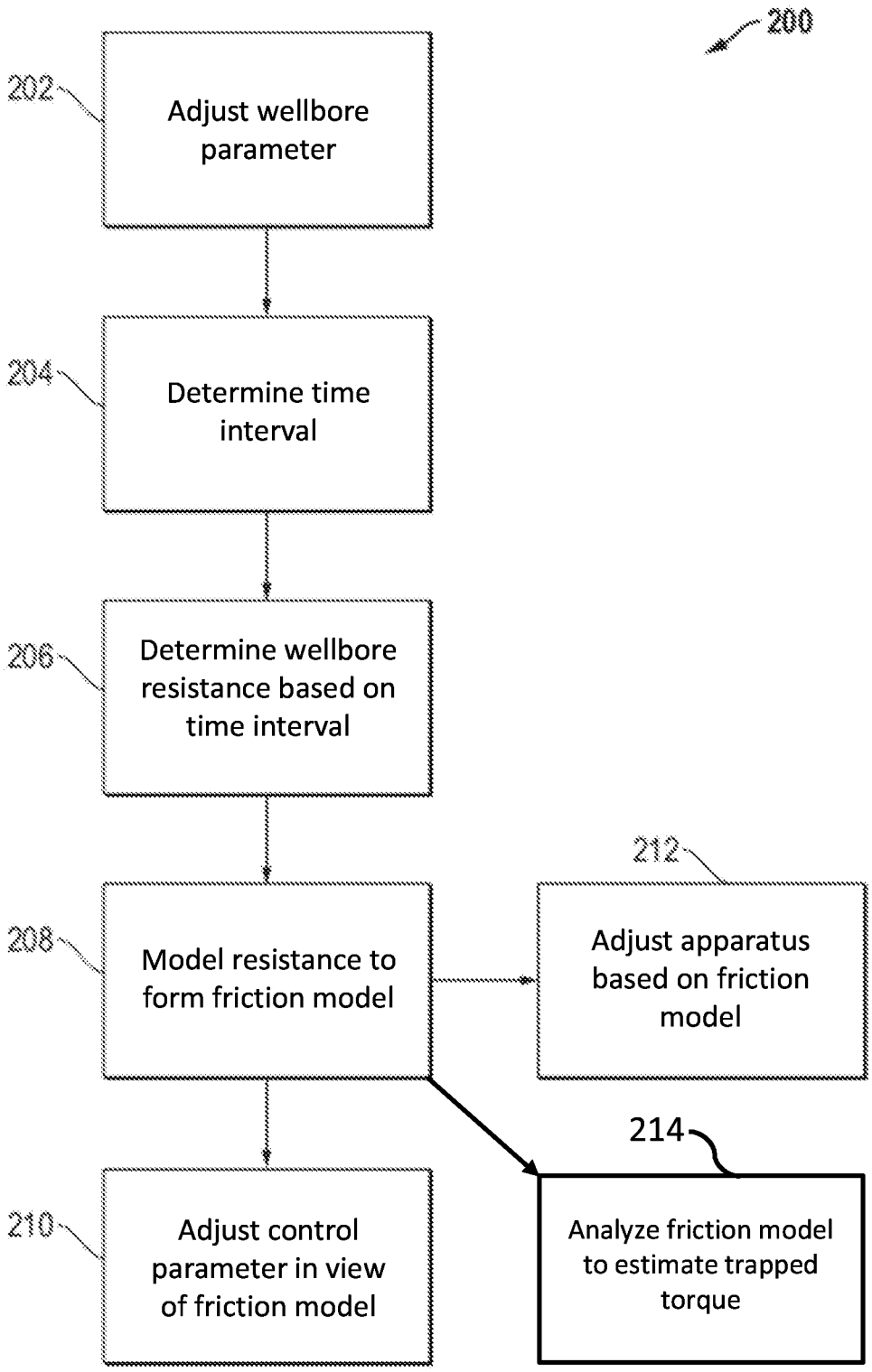
FIG. 2 includes a schematic flow chart of a method for subterranean drilling operations in accordance with an embodiment.

FIG. 2 illustrates a method 200 for subterranean drilling operations. The method 200 can include adjusting 202 a wellbore parameter, measuring (or determining) 204 a time interval T between adjustment of the wellbore parameter and a resulting change at a bottom hole assembly of the drill string 120, using 206 the time interval T and determining resistance in the wellbore 112, and modeling 208 the resistance to form a friction model of the wellbore 112.

As used herein, a "wellbore parameter" can refer to a wellbore parameter corresponding relatively in time with a wellbore parameter adjustment occurring prior to measuring 204 the time interval T, where the time interval T is the time between adjustment of the wellbore parameter and a resulting change of the wellbore parameter at the bottom hole assembly (or drill bit 104) of the drill rig 120. In a particular instance, the wellbore parameter is adjusted 202 (e.g. each time a pipe segment or pipe stand is added to the drill string 120) to permit modeling 208 of the resistance of the wellbore 112 as the drill string is extended further into the earthen formation, thereby forming a friction model. The adjusted wellbore parameter 202 can include, for example, adjusting a wellbore pressure, adjusting a rotational speed of the drill string 120, adjusting an axial position of the drill string 120 in the wellbore 112, adjusting fluid flow, or a combination thereof. In a particular embodiment, adjusting wellbore pressure can be performed by adjusting a valve in one or more mud pumps, valves, or chokes (not illustrated) of the drilling apparatus 102. In certain instances, the one or more pumps, valves, or chokes, of the drilling apparatus 102 can be disposed at or adjacent to the surface at a location on the drill site. Adjusting wellbore pressure can include, for example, starting pumps, stopping pumps, raising wellbore pressure, lowering wellbore pressure, or a combination thereof. In a particular embodiment, adjusting the rotational speed of the drill string 120 can be performed by adjusting a speed or torque of the drive unit 118. For example, in an embodiment, the rotational speed of the drill string 120 can be approximately 0 revolutions per minute (RPM) prior to adjusting the rotational speed of the drill string 120 to detect and measure 204 a time interval T thereof to the BHA (or drill bit 104).

In certain instances, adjusting 204 the wellbore parameter can occur at equally, or approximately equally, spaced apart locations in the wellbore 112 or at a plurality of equally, or approximately equally, spaced apart time periods during drilling operations. In a particular instance the plurality of approximately equally spaced locations or times can generally correspond to times when pipe segments or pipe stands are added to the drill string 120. That is, for example, adjusting the wellbore pressure or rotational speed of the drill string 120 can occur at successive pipe joint operations. The pipe joint operations can include addition or removal of individual pipe segments from the drill string 120 or addition or removal of pipe stands comprised of a plurality of pipe segments coupled together.

In other instances, adjusting 204 the wellbore parameters can occur at non-equally spaced apart locations in the wellbore 112. That is, for example, adjusting 204 the wellbore parameters can occur at intervals such as a first interval, a second interval, and a third interval where a time or distance between the first and second intervals is different than a time or distance between the second and third intervals.

In an embodiment, adjusting 202 the wellbore parameter includes both adjusting the wellbore pressure and adjusting the rotational speed of the drill string 120. In a particular embodiment, adjustment of the wellbore pressure is performed before adjusting the rotational speed of the drill string 120. In another particular embodiment, adjustment of the rotational speed of the drill string 120 is performed at least 0.01 seconds after adjustment of the wellbore pressure, at least 0.1 seconds after adjustment of the wellbore pressure, at least 0.25 seconds after adjustment of the wellbore pressure, at least 0.5 seconds after adjustment of the wellbore pressure, at least 0.75 seconds after adjustment of the wellbore pressure, at least 1 second after adjustment of the wellbore pressure, or at least 2 seconds after adjustment of the wellbore pressure. In a further particular embodiment, adjustment of the rotational speed of the drill string 120 is performed no greater than 10 seconds after adjustment of the wellbore pressure, no greater than 5 seconds after adjustment of the wellbore pressure, or no greater than 3 seconds after adjustment of the wellbore pressure. In a further particular embodiment, adjustment of the rotational speed of the drill string 120 is performed no greater than 120 seconds after adjustment of the wellbore pressure, no greater than 115 seconds after adjustment of the wellbore pressure, or no greater than 110 seconds after adjustment of the wellbore pressure, or no greater than 100 seconds after adjustment of the wellbore pressure, or no greater than 90 seconds after adjustment of the wellbore pressure, or no greater than 80 seconds after adjustment of the wellbore pressure, or no greater than 70 seconds after adjustment of the wellbore pressure, or no greater than 10 seconds after adjustment of the wellbore pressure.

In an embodiment, adjusting the rotational speed of the drill string 112 is performed a pre-determined length of time after adjusting the wellbore pressure. For example, adjusting the rotational speed of the drill string 112 can occur at a fixed (e.g., constant) time interval with respect to adjustment of the wellbore pressure. In another embodiment, the rotational speed of the drill string 112 can occur a non-fixed, predetermined length of time after adjusting the wellbore pressure.

In certain instances adjusting the rotational speed of the drill string 112 can be performed along a predetermined, input torque profile. That is, drill string rotational speed can be adjusted along a predetermined torque, or ramp, cycle. In other instances, adjusting the rotational speed of the drill string 112 can be performed along a predetermined, input speed profile. For example, the drill string rotational speed can be adjusted along a predetermined speed, or ramp, cycle. In yet other instances, adjusting the rotational speed of the drill string 112 can be performed along a predetermined, input speed profile and a predetermined, input torque profile.

In an embodiment, at least one of the drill string 120 and bit 104 (or bottom hole assembly associated with the bit 104) can be adapted to detect a received torque profile or a received speed profile from the drill string 120. In a more particular embodiment, at least one of the drill string 120 and bit 104 (or bottom hole assembly associated with the bit 104) can be adapted to measure a received torque profile or a received speed profile from the dill string 120. In an embodiment, the bit 104 (or bottom hole assembly) can include one or more sensors adapted to detect the occurrence of the torque. In a more particular embodiment, the bit 104 (or bottom hole assembly) can include one or more sensors adapted to detect the torque profile received from the drill string 120.

In an embodiment, the friction model can include a model of wellbore 112 conditions. More particularly, the friction model can include a model of wellbore 112 friction. For example, the friction model can include a log of determined resistance in the wellbore 112. As additional measurements of time intervals between adjusting 202 the wellbore parameter and the resulting change at the bottom hole assembly are calculated, they can be included in the friction model. In a particular embodiment, the friction model can include approximately equally spaced apart determined resistances in the wellbore 112 as measured using at least a portion of the method 200 described herein.

In a particular instance, the friction model can be used to predict a future resistance in the wellbore 112. For example, a best fit line, curve, or representation of the friction model can be determined and a future wellbore resistance analyzed. Additional information, such as formation rheology, surface and sub-surface mapping studies, or other information can be used to update the analyzed future wellbore resistance for increased predictive accuracy.

In certain instances, the frictional model can be adjusted by comparing the input torque profile, as caused at or near the surface, to the received torque profile, as detected at or near the bit 104 or bottom hole assembly. In other instances, the frictional model can be adjusted by comparing the input speed profile to the received speed profile. In yet further instances, the frictional model can be adjusted by comparing the input speed profile to the received speed profile and comparing the input torque profile to the received torque profile. In certain instances, such comparisons can increase accuracy of the frictional model. In a particular embodiment, comparison between the input speed or torque profile and the received speed or torque profile can occur at least partially autonomously—e.g., at least a portion of the comparison can occur without active user intervention.

In an embodiment, the method 200 can further include adjusting 212 the drilling apparatus 102 based on the friction model. For example, in a particular embodiment, adjusting 212 the drilling apparatus 102 based on the friction model can include adjusting the tool face 108 orientation. This may be particularly useful during directional drilling applications where wellbore friction can be difficult to determine or correct for.

In an embodiment, the display apparatus 128 can be adapted to display electronic data corresponding to the process or control parameter on a user-viewable display. In a particular embodiment, the display apparatus 128 can be adapted to display electronic data corresponding to the friction model on a user-viewable display.

In certain embodiments, modeling 208 the resistance to form the friction model includes analyzing the drill string 120 composition, a bottom hole assembly composition or size, bit 104 properties, wellbore 112 properties, drilling mud properties, flow rates, wellbore 120 tortuosity, or any combination thereof.

In an embodiment, the method 200 can further include adjusting 210 a control parameter of the wellbore in view of the friction model. By way of non-limiting example, adjusting 210 the control parameter can adjust at least one operation including: tracking rotational orientation of a portion of the face 108 of the bit 104, adjustment of wellbore 112 fluid flow rate, adjustment of drill string 120 rotational speed, adjustment of drill string 120 torque, determining movements of the drill string 120 to reduce friction along the drill string 120, or any combination thereof. As used herein, a "control parameter" can refer to a wellbore parameter adjusted to control a wellbore condition not for the purpose of measuring the time interval T between adjustment of the wellbore parameter and a resulting change at the bottom hole assembly of the drill rig. In an embodiment, adjusting 210 the control parameter of the subterranean drilling operation is performed in view of a friction model of the wellbore. Thus, for example, adjusting 210 the control parameter can adjust a wellbore control parameter such as adjusting a valve on a mud pump, altering a torque or speed of the drill string 120 at a drive unit 118, adjusting or tracking rotational orientation of a portion of the face 108 of the bit 104 or other portion of the bottom hole assembly, adjusting the movement of the drill string 120 to reduce friction along the drill string 120, or a combination thereof performed to control a wellbore 112. In certain non-limiting instances, the adjusted control parameter can correspond with the adjusted wellbore parameter. That is, the control and wellbore parameters can be the same. For example, adjustment 202 of the wellbore parameter can include adjusting a valve on a mud pump to adjust pressure within the wellbore 112 for purpose of measuring 204 a time interval between adjustment of the wellbore parameter and the resulting change at the bottom hole assembly, and adjustment 210 of the control parameter can include adjusting the valve on the mud pump to adjust pressure within the wellbore 112 to control or adjust drilling operations.

In an embodiment, modeling 208 resistance in the wellbore 112 is performed by a logic device 130, such as a microprocessor. The logic device 130 can be coupled with a memory device 132 adapted to store data associated with measuring 208 resistance in the wellbore 112. In a particular instance, the memory device 132 can be adapted to store a friction value sent by the logic device 130. In certain instances, the logic device 130 can be coupled with the receiving apparatus 128 or a portion thereof.

In an embodiment, the bit 104 or bottom hole assembly can be adapted to sense a rotational speed of the drill string 120 at or adjacent to the bit 104 or bottom hole assembly. The bit 104 or bottom hole assembly can be adapted to relay the sensed rotational speed to the logic device 130 or another logic device of the drilling apparatus 102.

In another embodiment, the bit 104 or bottom hole assembly can be adapted to sense a wellbore pressure at or adjacent to the bit 104 or bottom hole assembly. The bit 104 or bottom hole assembly can be adapted to relay the sensed wellbore pressure to the logic device 130 or another logic device of the drilling apparatus 102.

In an embodiment, the system 100 can be adapted to analyze 214 the friction model to estimate trapped torque in the drill string 120. For example, the logic device 130 can calculate a difference between the friction model and the received torque at the bit 104 or bottom hole assembly. The difference can refer to the trapped torque in the drill string 120. By way of a non-limiting example, trapped torque can refer to torque in the drill string 120 that is insufficient to overcome static friction, known as stiction. As a result, the torque is trapped and the drill string 120 is prime for an overshoot which can damage the bit 104, bottom hole assembly, drill string 120, drive unit 118, or other components of the drilling apparatus 102.

The present invention has broad applicability and can provide many benefits as described and shown in the examples above. The embodiments will vary greatly depending upon the specific application, and not every embodiment will provide all of the benefits and meet all of the objectives that are achievable by the invention. Note that not all of the activities described above in the general description or the examples are required, that a portion of a specific activity may not be required, and that one or more further activities may be performed in addition to those described. Still further, the order in which activities are listed are not necessarily the order in which they are performed.

Embodiments of the present invention are described generally herein in relation to drilling directional wells or unconventional wells, but it should be understood, however, that the methods and the apparatuses described may be equally applicable to other drilling environments. Further, while the descriptions and figures herein show a land-based drilling rig, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others within the scope of the present disclosure.

VARIOUS EMBODIMENTS

Embodiment 1. A method for subterranean drilling operations comprising:

adjusting a wellbore parameter;

measuring a time interval between adjustment of the wellbore parameter and a resulting change at a bottom hole assembly of a drill string;

using the measured time interval and determining resistance in the wellbore; and modeling the resistance to form a friction model of the wellbore.

Embodiment 2. The method of embodiment 1 further comprising:

adjusting a control parameter of the subterranean drilling operation in view of the friction model.

Embodiment 3. The method of embodiment 2, wherein adjusting the control parameter adjusts at least one operation selected from the group of:

tracking rotational orientation of a portion of the face of a drill bit;

adjustment of wellbore fluid flow rate;

adjustment of drill string rotational speed determining movements of the drill string to reduce friction in the drill string;

adjusting tool face orientation; or a combination thereof.

Embodiment 4. The method of embodiment 1, wherein adjusting the wellbore parameter comprises adjusting a wellbore pressure, adjusting a rotational speed of the drill string, or a combination thereof.

Embodiment 5. The method of embodiment 4, wherein the rotational speed of the drill string is approximately 0 revolutions per minute (RPM) prior to adjusting the rotational speed of the drill string.

Embodiment 6. The method of embodiment 4, wherein adjusting the wellbore pressure comprises raising the wellbore pressure, lowering the wellbore pressure, starting pumps, stopping pumps, or a combination thereof.

Embodiment 7. The method of embodiment 4, wherein adjusting the rotational speed of the drill string occurs at successive pipe joint operations.

Embodiment 8. The method of embodiment 4, wherein adjusting the wellbore pressure is performed by a pump.

Embodiment 9. The method of embodiment 4, wherein adjusting the rotational speed of the drill string is performed at or adjacent to a surface of the subterranean formation.

Embodiment 10. The method of embodiment 4, wherein adjusting the rotational speed of the drill string is performed by a top drive.

Embodiment 11. The method of embodiment 4, wherein adjusting the wellbore pressure is performed before adjusting the rotational speed of the drill string.

Embodiment 12. The method of embodiment 4, wherein adjusting the rotational speed of the drill string is performed a pre-determined length of time after adjusting the wellbore pressure.

Embodiment 13. The method of embodiment 4, wherein adjusting the rotational speed of the drill string is performed along a predetermined, input torque profile or a predetermined, input speed profile.

Embodiment 14. The method of embodiment 13, wherein at least one of the drill string and bottom hole assembly is adapted to detect and measure a received torque profile or a received speed profile from the drill string.

Embodiment 15. The method of embodiment 14, further comprising adjusting the frictional model by comparing the input torque profile to the received torque profile or the input speed profile to the received speed profile.

Embodiment 16. The method of embodiment 1, wherein determining resistance in the wellbore is performed by a logic device, and wherein the logic device is coupled with a memory device adapted to store the pressure and rotational resistances.

Embodiment 17. The method of embodiment 1, further comprising: sensing a rotational speed of the drill string at the bottom hole assembly and relaying the sensed speed to a logic device.

Embodiment 18. The method of embodiment 1, further comprising: sensing a wellbore pressure at the bottom hole assembly and relaying the sensed pressure to a logic device.

Embodiment 19. The method of embodiment 1, wherein the friction model comprises at least three data entries approximately equally spaced apart in wellbore depth.

Embodiment 20. The method of embodiment 1, wherein adjusting the wellbore parameter is performed at or adjacent to a surface of the subterranean formation.

Embodiment 21. The method of embodiment 1, further comprising:

adjusting a drilling apparatus based on the friction model, wherein adjusting the drilling apparatus comprises adjusting the tool face orientation.

Embodiment 22. The method of embodiment 1, further comprising displaying electronic data corresponding to the wellbore parameter on a user-viewable display.

Embodiment 23. The method of embodiment 1, further comprising displaying electronic data corresponding to the friction model on a user-viewable display.

Embodiment 24. The method of embodiment 1, wherein the wellbore parameter comprises a rotational speed of the drill string and a second wellbore parameter.

Embodiment 25. The method of embodiment 1, further comprising analyzing the friction model to estimate trapped torque in the drill string.

Embodiment 26. The method of embodiment 25, wherein analyzing the friction model is performed by a logic device.

Embodiment 27. The method of embodiment 1, wherein modeling the resistance to form the friction model comprises analyzing at least one of a drill string composition, a bottom hole assembly composition or size, bit properties, wellbore properties, drilling mud properties, flow rates, wellbore tortuosity, and any combination thereof.

Embodiment 28. The method of embodiment 1, wherein measuring the time interval is performed by the bottom hole assembly.

Embodiment 29. A system for conducting subterranean operations comprising:

a wellbore friction modeling system comprising:

a logic device adapted to calculate a time interval between adjustment of a wellbore parameter at the surface and occurrence of the wellbore parameter at a bottom hole assembly; and a controller configured to receive a command signal from the logic device with instructions to change a control parameter in response to the time interval.

Embodiment 30. The system of embodiment 29, wherein the wellbore parameter is selected from at least one of a wellbore pressure and a drill string rotational speed.

Embodiment 31. The system of embodiment 30, wherein the system is adapted to adjust the control parameter at fixed intervals.

Embodiment 32. The system of embodiment 31, wherein the fixed intervals relate to fixed distances between successively measured depths.

Embodiment 33. The system of embodiment 29, wherein the bottom hole assembly comprises a detecting element adapted to detect the occurrence of the wellbore parameter at the bottom hole assembly.

Embodiment 34. The system of embodiment 29, wherein the logic device is further adapted to send a friction value signal comprising the friction value to a memory device adapted to store the friction value.

Embodiment 35. The system of embodiment 29, wherein the wellbore friction modeling system is adapted to generate a wellbore friction model.

Embodiment 36. The system of embodiment 29, wherein the wellbore friction model includes at least three data entries approximately equally spaced apart in wellbore depth.

Embodiment 37. An apparatus for guiding a drilling operation comprising:

a drilling apparatus comprising a bit with a steerable motor having a tool face and a rotary drive adapted to steer the bit during a drilling operation, and a mud pump system;

a receiving apparatus adapted to receive electronic data on a recurring basis, wherein the electronic data comprises actual mud travel time data, actual rotation travel time data, theoretical rotation travel time data, or actual tool face orientation data; and a display apparatus adapted to display the electronic data on a user-viewable display.

Embodiment 38. The apparatus of embodiment 37, wherein the receiving apparatus is adapted to analyze the received electronic data and determine an updated tool face orientation.

Embodiment 39. The apparatus of embodiment 37, wherein the drilling apparatus is adapted to receive updated tool face orientation and adjust the drilling apparatus to obtain the updated tool face orientation or display an expected rotation of the drill string based on a model.

Embodiment 40. The apparatus of embodiment 37, wherein the received electronic data can be compared to a model used to update information on the user-viewable display.

Embodiment 41. A method for a subterranean drilling operation comprising:

adjusting a wellbore parameter;

calculating a time interval T between adjustment of the wellbore parameter and a resulting change at a bottom hole assembly of a drill string;

using the time interval T and determining resistance in a wellbore; and modeling the resistance to form a friction model of the wellbore.

Embodiment 42. The method of embodiment 41, wherein the adjusting the wellbore parameter further comprises:

adjusting the wellbore parameter at a surface of a subterranean formation, such that the adjusted wellbore parameter causes the resulting change of the wellbore parameter at the bottom hole assembly.

Embodiment 43. The method of embodiment 41, wherein the calculating the time interval T further comprises:

transmitting a control signal from a surface of a subterranean formation to the bottom hole assembly of the drill string in the wellbore, measuring a time interval T(1) between when the control signal is transmitted at the surface and when the wellbore parameter is adjusted at the surface, measuring a time interval T(2) between when the control signal is received at the bottom hole assembly and when the resulting change is detected at the bottom hole assembly, and calculating the time interval T in the wellbore based on a difference between the T(1) and T(2) time intervals.

Embodiment 44. The method of embodiment 43, further comprising calculating a friction value FV of the wellbore based the time interval T.

Embodiment 45. The method of embodiment 44, further comprising calculating a friction value FV each time a pipe segment is added to the drill string, wherein each successive friction value FV represents a change from a last calculated friction value; and building a friction model of the wellbore based on incremental changes between successive friction values FV.

Embodiment 46. The method of embodiment 44 further comprising:

adjusting a control parameter of the subterranean drilling operation in view of the friction value FV.

Embodiment 47. The method of embodiment 46, wherein adjusting the control parameter adjusts at least one operation selected from a group consisting of:

tracking rotational orientation of a portion of a face of a drill bit;

adjusting a wellbore fluid flow rate;

adjusting a drill string rotational speed;

determining movements of the drill string to reduce friction in the drill string;

adjusting tool face orientation; or a combination thereof.

Embodiment 48. The method of embodiment 41, wherein adjusting the wellbore parameter comprises: adjusting a wellbore pressure;

adjusting a rotational speed of the drill string;

starting pumps;

stopping pumps; or a combination thereof.

Embodiment 49. The method of embodiment 48, wherein the rotational speed of the drill string is approximately 0 revolutions per minute (RPM) prior to adjusting the rotational speed of the drill string.

Embodiment 50. The method of embodiment 48, wherein adjusting the wellbore pressure comprises raising the wellbore pressure, lowering the wellbore pressure, or a combination thereof.

Embodiment 51. The method of embodiment 48, wherein adjusting the rotational speed of the drill string occurs at successive pipe joint operations.

Embodiment 52. The method of embodiment 48, wherein adjusting the rotational speed of the drill string is performed along a predetermined, input torque profile or a predetermined, input speed profile.

Embodiment 53. The method of embodiment 52, further comprising adjusting the frictional model by comparing the input torque profile to a received torque profile or the input speed profile to a received speed profile.

Embodiment 54. The method of embodiment 41, further comprising analyzing the friction model to estimate trapped torque in the drill string.

Embodiment 55. A method for a subterranean drilling operation comprising:

transmitting a control signal from a surface of a subterranean formation to a bottom hole assembly of a drill string in a wellbore;

adjusting a wellbore parameter at the surface of a subterranean formation;

measuring a time interval T(1) between when the control signal is transmitted at the surface and when the wellbore parameter is adjusted at the surface;

measuring a time interval T(2) between when the control signal is received at the bottom hole assembly and when a resulting change is detected at the bottom hole assembly; and calculating a time interval T based on a difference between the T(1) and T(2) time intervals.

Embodiment 56. The method of embodiment 55, wherein the adjusting the wellbore parameter further comprises:

adjusting the wellbore parameter at the surface, such that the adjusted wellbore parameter causes a resulting change of the wellbore parameter at the bottom hole assembly.

Embodiment 57. The method of embodiment 55, further comprising calculating a friction value FV of the wellbore based the time interval T.

Embodiment 58. The method of embodiment 57 further comprising: adjusting a control parameter of the subterranean drilling operation in view of the friction value FV.

Embodiment 59. The method of embodiment 58, wherein adjusting the control parameter adjusts at least one operation selected from a group consisting of:

tracking rotational orientation of a portion of a face of a drill bit;

adjusting a wellbore fluid flow rate;

adjusting a drill string rotational speed;

determining movements of the drill string to reduce friction in the drill string;

adjusting tool face orientation; or a combination thereof.

Embodiment 60. The method of embodiment 57, wherein determining the friction value FV of the wellbore occurs at successive pipe joint operations.

Embodiment 61. The method of embodiment 60, wherein a friction model of the wellbore is developed incrementally as each of the successive pipe joint operations is performed.

Embodiment 62. The method of embodiment 55, wherein the control signal is selected from a group consisting of:

an acoustic signal;

axial motion of the drill string;
a pressure pulse in a fluid in the wellbore;
stopping flow of fluid in the wellbore;
starting flow of fluid in the wellbore;
adjusting flow of fluid in the wellbore;
an electrical signal;
a communication signal;
a communication message; or
a combination thereof.

Embodiment 63. The method of embodiment 55, wherein the wellbore parameter is selected from a group consisting of:
axial movement of the drill string;
rotational movement of the drill string;
rotational speed of the drill string; or
a combination thereof.

Embodiment 64. The method of embodiment 63, wherein the rotational speed of the drill string is approximately 0 revolutions per minute (RPM) prior to adjusting the rotational speed of the drill string.

Embodiment 65. The method of embodiment 63, wherein adjusting the axial movement of the drill string comprises raising the drill string, lowering the drill string, or a combination thereof.

Embodiment 66. The method of embodiment 63, wherein adjusting the rotational speed of the drill string is performed along an input torque profile that is predetermined or an input speed profile that is predetermined, and wherein the bottom hole assembly is adapted to detect and measure a received torque profile or a received speed profile from the drill string.

Embodiment 67. The method of embodiment 66, further comprising:
modeling the resistance to form a friction model of the wellbore; and
performing one or more operations in a group consisting of:
adjusting the friction model by comparing the input torque profile to the received torque profile or the input speed profile to the received speed profile,
adjusting a drilling apparatus based on the friction model, and
analyzing the friction model to estimate trapped torque in the drill string.

Embodiment 68. A system for conducting a subterranean operation comprising:
a wellbore friction modeling system comprising:
a logic device configured to:
initiate transmission of a control signal from a surface of a subterranean formation to a bottom hole assembly,
initiate an adjustment of a wellbore parameter at the surface, such that the adjustment of the wellbore parameter causes a resultant change of the wellbore parameter at the bottom hole assembly,
calculate a time interval T(1) between when the control signal is transmitted at the surface and when the wellbore parameter is adjusted at the surface, and
calculate a time interval T(2) between when the control signal is received at the bottom hole assembly and when the resultant change in the wellbore parameter is detected at the bottom hole assembly; and
calculate a time interval T based on a difference in the time intervals T(1) and T(2).

Embodiment 69. The system of embodiment 68, wherein the logic device is further configured to calculate a friction value FV of a wellbore based on the time interval T.

Embodiment 70. The system of embodiment 69, wherein the logic device is further configured to adjust a control parameter of the subterranean operation in view of the friction value FV.

Embodiment 71. The system of embodiment 70, wherein the control parameter is selected from a group consisting of:
tracking rotational orientation of a portion of a face of a drill bit;
adjusting a wellbore fluid flow rate;
adjusting a rotational speed of a drill string;
determining movements of the drill string to reduce friction in the drill string;
adjusting tool face orientation; or
a combination thereof.

Embodiment 72. The system of embodiment 69, wherein the logic device is further configured to calculate the friction value FV of the wellbore at successive pipe joint operations.

Embodiment 73. The system of embodiment 72, wherein the logic device is further configured to model a friction profile of the wellbore based on the friction value FV calculated at each successive pipe joint operation.

Embodiment 74. The system of embodiment 68, wherein the control signal is selected from a group consisting of:
an acoustic signal;
axial motion of a drill string;
a pressure pulse in a fluid in the wellbore;
stopping flow of fluid in the wellbore;
starting flow of fluid in the wellbore;
adjusting flow of fluid in the wellbore;
an electrical signal;
a communication signal;
a communication message; or
a combination thereof.

Embodiment 75. The system of embodiment 68, wherein the wellbore parameter is selected from a group comprising:
axial movement of a drill string;
rotational movement of the drill string;
rotational speed of the drill string; or
a combination thereof.

The invention claimed is:

1. A method for a subterranean drilling operation comprising:
adjusting a wellbore parameter;
calculating a time interval T between adjustment of the wellbore parameter and a resulting change at a bottom hole assembly of a drill string;
using the time interval T and determining resistance in a wellbore; and
modeling the resistance to form a friction model of the wellbore; and
analyzing the friction model to estimate trapped torque in the drill string.

2. The method of claim 1, wherein the calculating the time interval T further comprises:
transmitting a control signal from a surface of a subterranean formation to the bottom hole assembly of the drill string in the wellbore,
measuring a time interval T(1) between when the control signal is transmitted at the surface and when the wellbore parameter is adjusted at the surface,
measuring a time interval T(2) between when the control signal is received at the bottom hole assembly and when the resulting change is detected at the bottom hole assembly, and
calculating the time interval T in the wellbore based on a difference between the T(1) and T(2) time intervals.

3. The method of claim 2, further comprising:
calculating a friction value FV of the wellbore based on the time interval T;
calculating a friction value FV each time a pipe segment is added to the drill string, wherein each successive friction value FV represents a change from a last calculated friction value; and building a friction model of the wellbore based on incremental changes between successive friction values FV; and
adjusting a control parameter of the subterranean drilling operation in view of the friction value FV, wherein the control parameter is selected from a group consisting of:
tracking rotational orientation of a portion of a face of a drill bit;
adjusting a wellbore fluid flow rate;
adjusting a drill string rotational speed;
determining movements of the drill string to reduce friction in the drill string;
adjusting tool face orientation; or
a combination thereof.

4. The method of claim 1, wherein adjusting the wellbore parameter comprises:
adjusting a wellbore pressure;
adjusting a rotational speed of the drill string;
starting pumps;
stopping pumps; or
a combination thereof.

5. The method of claim 4, wherein the rotational speed of the drill string is 0 revolutions per minute (RPM) prior to adjusting the rotational speed of the drill string, wherein adjusting the wellbore pressure comprises raising the wellbore pressure, lowering the wellbore pressure, or a combination thereof, and wherein adjusting the rotational speed of the drill string occurs at successive pipe joint operations.

6. The method of claim 4, wherein adjusting the rotational speed of the drill string is performed along a predetermined, input torque profile or a predetermined, input speed profile.

7. The method of claim 6, further comprising adjusting the frictional model by comparing the input torque profile to a received torque profile or the input speed profile to a received speed profile.

8. The method of claim 1, wherein the adjusting the wellbore parameter further comprises: adjusting the wellbore parameter at a surface of a subterranean formation, such that the adjusted wellbore parameter causes the resulting change of the wellbore parameter at the bottom hole assembly.

9. A method for a subterranean drilling operation comprising:
transmitting a control signal from a surface of a subterranean formation to a bottom hole assembly of a drill string in a wellbore;
adjusting a wellbore parameter at the surface of a subterranean formation;
measuring a time interval T(1) between when the control signal is transmitted at the surface and when the wellbore parameter is adjusted at the surface;
measuring a time interval T(2) between when the control signal is received at the bottom hole assembly and when a resulting change is detected at the bottom hole assembly;
calculating a time interval T based on a difference between the T(1) and T(2) time intervals;
calculating a friction value FV of the wellbore based on the time interval T;
developing a friction model of the wellbore based on the friction value FV; and
analyzing the friction model to estimate trapped torque in the drill string.

10. The method of claim 9, further comprising:
adjusting a control parameter of the subterranean drilling operation in view of the friction value FV, wherein adjusting the control parameter adjusts at least one operation selected from a group consisting of:
tracking rotational orientation of a portion of a face of a drill bit;
adjusting a wellbore fluid flow rate;
adjusting a drill string rotational speed;
determining movements of the drill string to reduce friction in the drill string;
adjusting tool face orientation; or
a combination thereof.

11. The method of claim 9, wherein determining the friction value FV of the wellbore occurs at successive pipe joint operations, and wherein a friction model of the wellbore is developed incrementally as each of the successive pipe joint operations is performed.

12. The method of claim 9, wherein the control signal is selected from a group consisting of:
an acoustic signal;
axial motion of the drill string;
a pressure pulse in a fluid in the wellbore;
stopping flow of fluid in the wellbore;
starting flow of fluid in the wellbore;
adjusting flow of fluid in the wellbore;
an electrical signal;
a communication signal;
a communication message; or
a combination thereof.

13. The method of claim 9, wherein the wellbore parameter is selected from a group consisting of:
axial movement of the drill string;
rotational movement of the drill string;
rotational speed of the drill string; or
a combination thereof.

14. The method of claim 13, wherein the rotational speed of the drill string is 0 revolutions per minute (RPM) prior to adjusting the rotational speed of the drill string,
wherein adjusting the axial movement of the drill string comprises raising the drill string, lowering the drill string, or a combination thereof,
wherein adjusting the rotational speed of the drill string is performed along an input torque profile that is predetermined or an input speed profile that is predetermined, and
wherein the bottom hole assembly is adapted to detect and measure a received torque profile or a received speed profile from the drill string.

15. The method of claim 9, further comprising:
calculating a friction value FV of the wellbore at successive pipe joint operations based on the time interval T calculated at the successive pipe joint operations; and
performing one or more operations in a group consisting of:
adjusting the friction model by comparing an input torque profile to a received torque profile or an input speed profile to a received speed profile, and
adjusting a drilling apparatus based on the friction model.

16. A system for conducting a subterranean operation comprising:

a wellbore friction modeling system comprising:

a logic device configured to:

initiate transmission of a control signal from a surface of a subterranean formation to a bottom hole assembly, initiate an adjustment of a wellbore parameter at the surface, such that the adjustment of the wellbore parameter causes a resultant change of the wellbore parameter at the bottom hole assembly, calculate a time interval T(1) between when the control signal is transmitted at the surface and when the wellbore parameter is adjusted at the surface, and calculate a time interval T(2) between when the control signal is received at the bottom hole assembly and when the resultant change in the wellbore parameter is detected at the bottom hole assembly;

calculate a time interval T based on a difference in the time intervals T(1) and T(2);

calculate a friction value FV of a wellbore based on the time interval T;

develop a friction model of the wellbore based on the friction value FV; and estimate a trapped torque in the drill string based on the friction model.

17. The system of claim 16, wherein the logic device is further configured to adjust a control parameter of the subterranean operation in view of the friction value FV.

18. The system of claim 17, wherein the control parameter is selected from a group consisting of:

tracking rotational orientation of a portion of a face of a drill bit;

adjusting a wellbore fluid flow rate;

adjusting a rotational speed of a drill string;

determining movements of the drill string to reduce friction in the drill string;

adjusting tool face orientation; or a combination thereof.

19. The system of claim 17, wherein the logic device is further configured to calculate the friction value FV of the wellbore at successive pipe joint operations, and to model a friction profile of the wellbore based on the friction value FV calculated at each successive pipe joint operation.

* * * * *